US010104930B2

(12) United States Patent
Feng et al.

(10) Patent No.: US 10,104,930 B2
(45) Date of Patent: Oct. 23, 2018

(54) ALL WEATHER CYCLING SHOE COVER

(71) Applicant: Rivet Sports, LLC, Santa Rosa, CA (US)

(72) Inventors: Zhen Zhou Feng, Santa Rosa, CA (US); Thomas N. Buckley, Narrabri (AU); Zhen-Yu Feng, Kuala Lampour (MY)

(73) Assignee: Rivet Sports, LLC, Santa Rosa, CA (US)

( * ) Notice: Subject to any disclaimer, the term of this patent is extended or adjusted under 35 U.S.C. 154(b) by 0 days.

(21) Appl. No.: 14/759,720

(22) PCT Filed: Jan. 17, 2014

(86) PCT No.: PCT/US2014/012054
§ 371 (c)(1),
(2) Date: Jul. 8, 2015

(87) PCT Pub. No.: WO2014/113674
PCT Pub. Date: Jul. 24, 2014

(65) Prior Publication Data

US 2015/0342289 A1 Dec. 3, 2015

Related U.S. Application Data

(60) Provisional application No. 61/754,534, filed on Jan. 19, 2013.

(51) Int. Cl.
*A43B 3/18* (2006.01)
*A43B 3/16* (2006.01)
(Continued)

(52) U.S. Cl.
CPC ..... *A43B 3/16* (2013.01); *A43B 5/14* (2013.01); *A43B 5/18* (2013.01); *A43B 7/12* (2013.01)

(58) Field of Classification Search
CPC .. A43B 3/16; A43B 3/166; A43B 5/14; A43B 5/18; A43B 7/12; A41B 11/10; A41B 11/08; A41D 13/06; A41D 17/00
(Continued)

(56) References Cited

U.S. PATENT DOCUMENTS 1,518,758 A * 12/1924 Rodee ..... A41B 11/08 2/61
1,543,353 A * 6/1925 Wolff ..... A41B 11/08 2/61
(Continued)

FOREIGN PATENT DOCUMENTS

CN 101721004 A 6/2010
RU 2306118 C2 9/2007
RU 108961 U1 10/2011

*Primary Examiner* — Jameson Collier
*Assistant Examiner* — Heather Mangine
(74) *Attorney, Agent, or Firm* — Dascenzo Intellectual Property Law, P.C.

(57) ABSTRACT

A cycling shoe cover is designed to provide maximum protection from the elements such as rain, snow, and cold. It also provides aerodynamic benefit with minimum weight. The cover is flexible unitary made from an elastomer, such as silicone or latex rubber, and is highly elastic and waterproof. The upper part of the cover fits snugly over the cyclist's ankle to prevent water egress into the shoes from above. The lower part of the cover snugly cover and seals to the bottom edge of the shoe without interfering with the cycling shoe's cleat or attachment to the cycle pedal.

21 Claims, 17 Drawing Sheets

(51) Int. Cl.
*A43B 5/14* (2006.01)
*A43B 5/18* (2006.01)
*A43B 7/12* (2006.01)

(58) Field of Classification Search
USPC ..... 2/239, 61; 602/3; 36/7.1 R, 7.2, 7.4, 7.3
See application file for complete search history.

(56) References Cited

U.S. PATENT DOCUMENTS 1,792,539 A * 2/1931 Huntman ..... A41D 17/00 36/2 R
2,015,648 A * 9/1935 Gammeter ..... B29C 41/14 156/184
2,109,134 A * 2/1938 Kendrick ..... A61F 13/08 2/239
2,117,417 A * 5/1938 Hall ..... A41D 19/0062 2/168
3,359,658 A * 12/1967 Price ..... A43B 3/163 36/7.1 R
3,373,510 A * 3/1968 Memole ..... A43B 3/0078 36/100
3,875,687 A * 4/1975 Henderson ..... A43B 3/16 36/7.1 R
4,043,326 A * 8/1977 Little ..... A61F 15/004 36/7.3
4,069,600 A * 1/1978 Wise ..... A43B 19/00 2/22
4,204,345 A * 5/1980 Bradley ..... A43B 5/0409 36/10
4,604,816 A * 8/1986 Davison ..... A43B 5/18 36/1.5
5,211,672 A * 5/1993 Andujar ..... A43B 5/00 36/106
5,412,957 A * 5/1995 Bradberry ..... A61F 13/08 2/239
5,579,539 A * 12/1996 Flick ..... A41D 19/0003 2/161.7
5,598,584 A * 2/1997 Da Grossa ..... A41D 19/0013 2/159
5,682,617 A * 11/1997 Tumas ..... A61F 13/08 2/239
5,728,052 A * 3/1998 Meehan ..... A61F 13/041 602/3
5,737,943 A * 4/1998 Bernhardt ..... A41B 11/00 2/239
5,953,756 A * 9/1999 Vrissimdjis ..... A41D 19/0082 2/16
6,047,403 A * 4/2000 Juozaitis ..... A61F 13/043 2/239
6,249,917 B1 * 6/2001 Vrissimdjis ..... A41D 19/0058 2/161.6
6,276,364 B1 * 8/2001 Warner ..... A61F 15/004 128/846
6,916,301 B1 * 7/2005 Clare ..... A61F 15/004 128/856
7,448,091 B2 * 11/2008 Kruss ..... A41D 19/0003 2/161.7
7,533,424 B2 * 5/2009 Symonds-Powell ... A41B 11/00 2/239
7,682,326 B2 * 3/2010 Song ..... A43B 5/00 2/239
2002/0066208 A1 * 6/2002 Hall ..... A43B 3/0078 36/7.3
2003/0046748 A1 * 3/2003 Tanenbaum ..... A41D 19/0089 2/209.13
2003/0154625 A1 * 8/2003 Royle ..... A01K 13/007 36/7.3
2004/0200097 A1 * 10/2004 Boyd ..... A43B 3/0078 36/96
2004/0262546 A1 * 12/2004 Thiess ..... A41D 19/015 250/515.1
2005/0229287 A1 * 10/2005 Mattesky ..... A41D 19/0089 2/161.8
2008/0052957 A1 * 3/2008 Taheri ..... A43B 3/106 36/7.1 R
2008/0092261 A1 * 4/2008 Yu ..... A41D 19/0089 2/16
2008/0092275 A1 * 4/2008 Wei ..... A41B 11/08 2/242
2009/0071037 A1 * 3/2009 Foxen ..... A43B 5/18 36/89
2010/0234781 A1 * 9/2010 Cassidy ..... A61F 5/01 602/3
2010/0301632 A1 * 12/2010 Bryne ..... A43B 5/14 296/180.1
2011/0023215 A1 2/2011 Obradovic
2011/0252581 A1 * 10/2011 Teichert ..... A43B 3/16 12/146 R
2012/0198595 A1 * 8/2012 Young ..... A41D 17/00 2/69

* cited by examiner

FIG. 3C
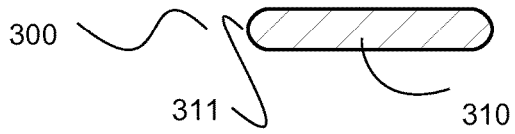
FIG. 3B
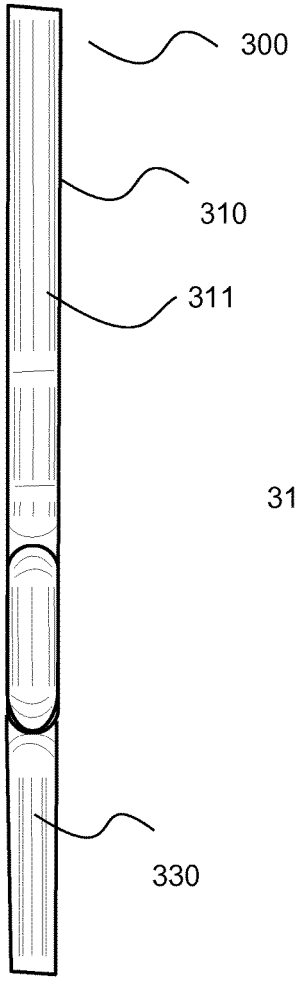
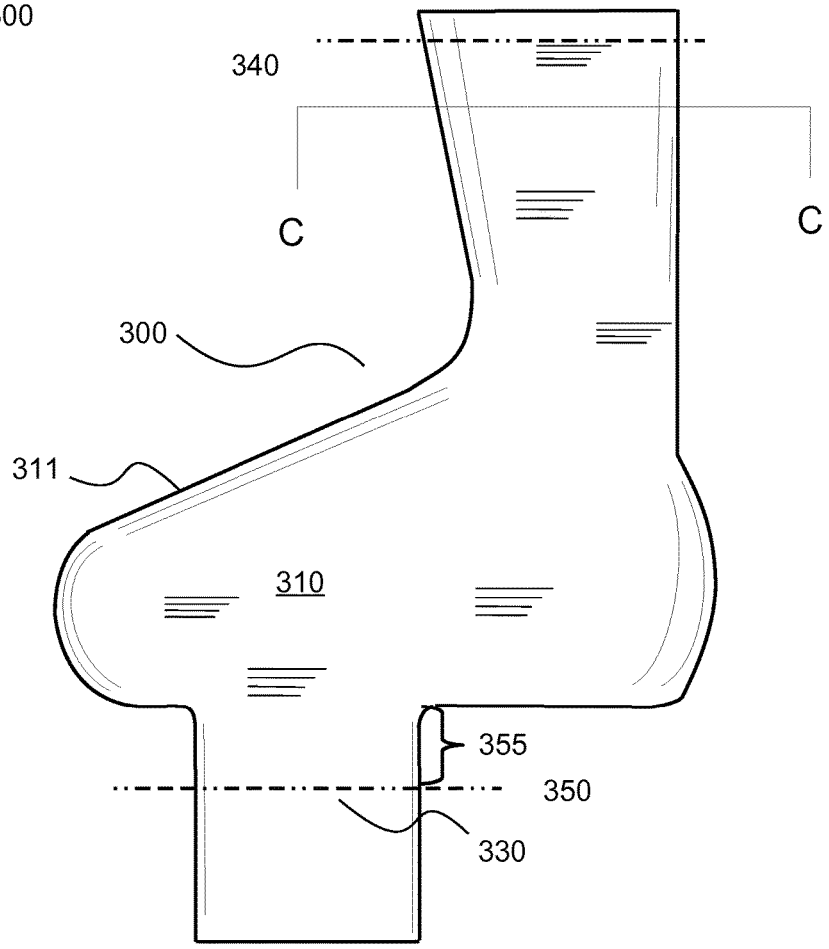
Dimensions in mm
FIG. 3A

FIG. 6C
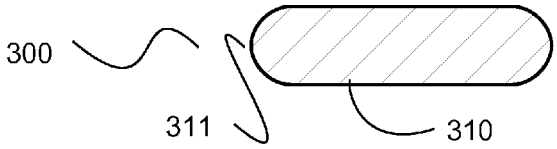
FIG. 6B
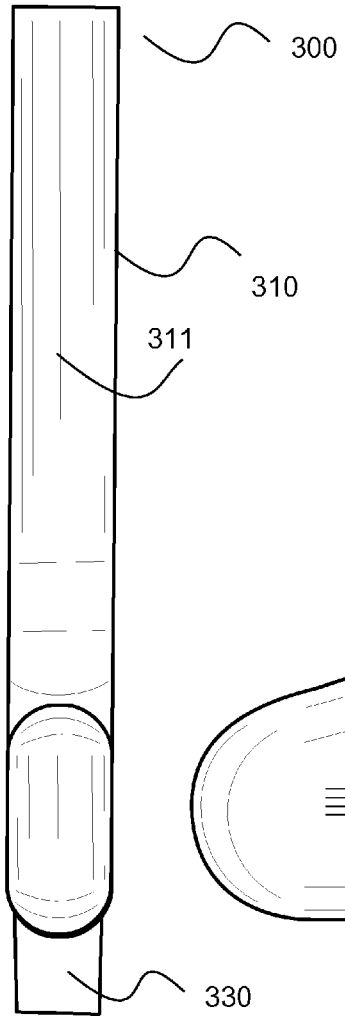
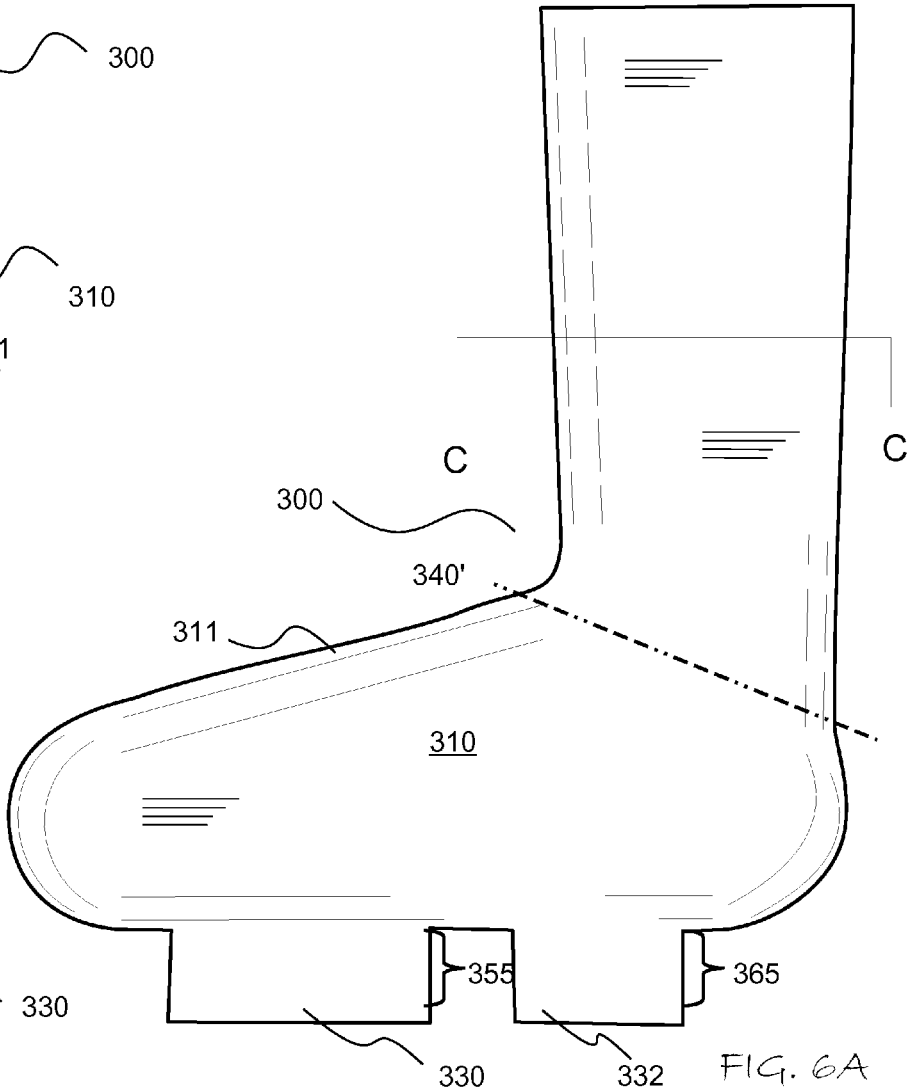
FIG. 6A

D
H
100

115
161
160
110
121
122
120
118
125
118
126
101

FIG. 11C
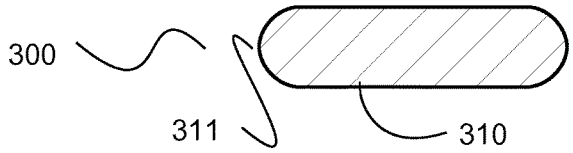
FIG. 11B
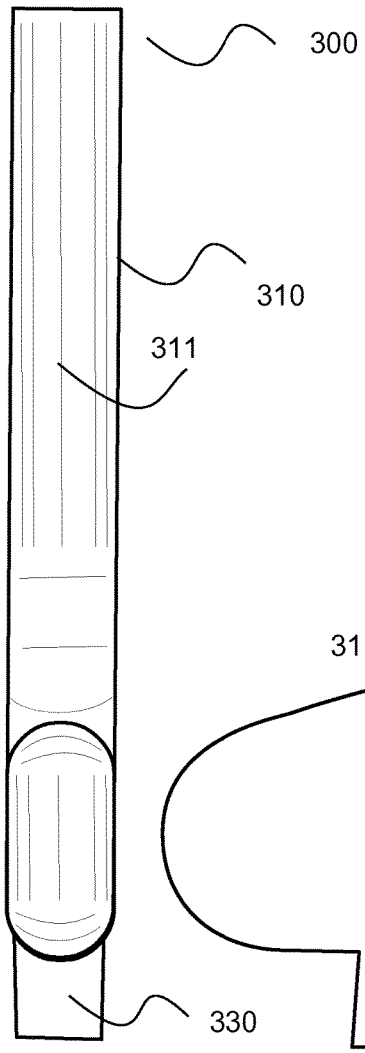
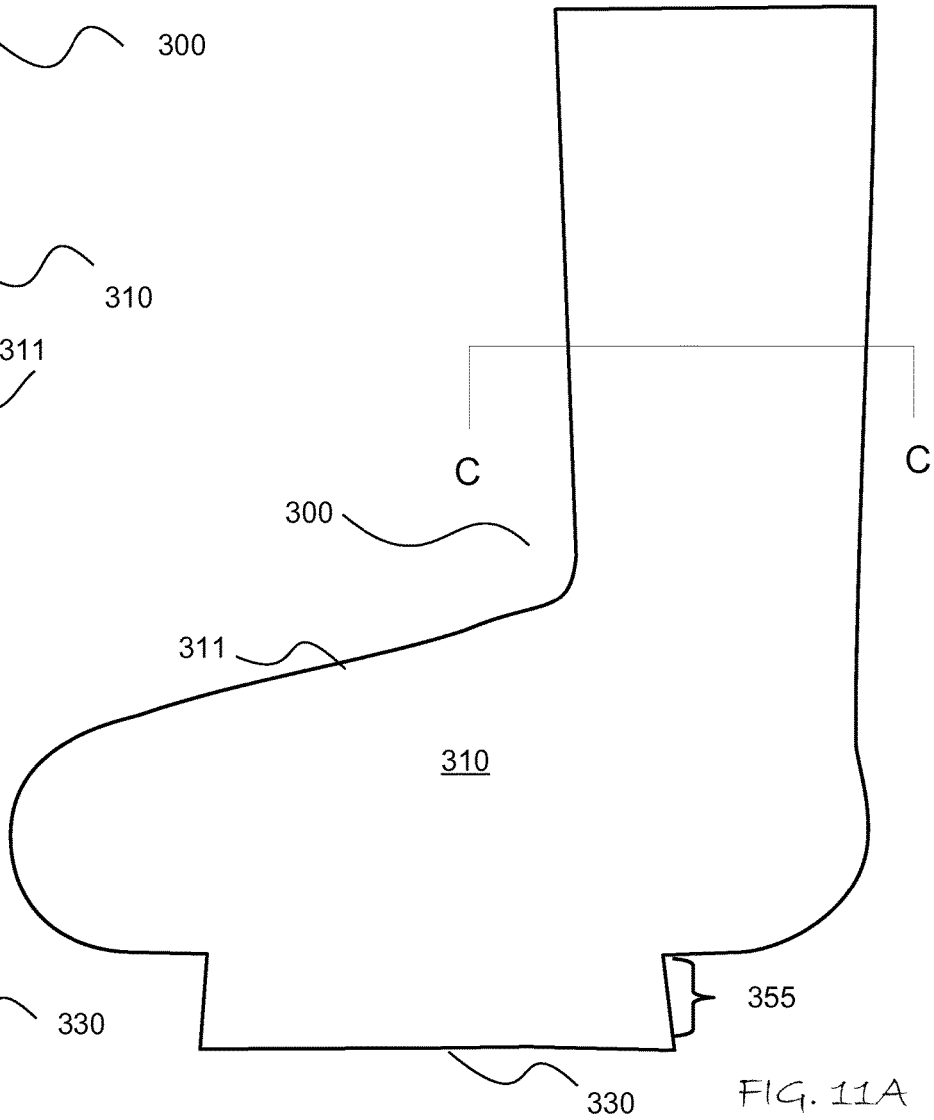
FIG. 11A

ALL WEATHER CYCLING SHOE COVER

CROSS REFERENCE TO RELATED APPLICATIONS

This application is an U.S. national phase application under 35 U.S.C. § 371 based upon co-pending International Application No. PCT/US2014/012054 filed on Jan. 17, 2014. Additionally, this U.S. national phase application claims the benefit of priority of co-pending International Application No. PCT/US2014/012054 filed on Jan. 17, 2014, which claims priority to U.S. Provisional Application No. 61/754,534 filed on Jan. 19, 2013. The entire disclosures of the prior applications are incorporated herein by reference. The international application was published on Jul. 24, 2014 under Publication No. WO 2014/113674 A1.

BACKGROUND OF INVENTION

The field of invention is protective covers for shoes or footwear, and more particularly bicycle shoes such as those used in competitive bicycle racing and the practice thereof.

Currently, most avid cyclists wear cycling shoes with cleats attached to the bottom of the shoes, which allow firm and secure contact with cycling pedals. Prior art shoe covers are intended to keep the feet of the cyclist dry in inclement weather, or when splashes from puddles and mud may hit the cyclist. Such shoe covers protect a portion of the shoe to some extent, but do not really keep the cyclist's feet dry. Further, such prior art or current cycling shoe covers are typically made from sheets of foamed and elastic fabric covered or filled NEOPRENE® brand rubber or LYCRA® or "Spandex" brand fabric materials, which are heavy or can lose water resistance after prolonged exposure to rain and snow. Most of these shoe covers are designed to slip over the shoe from below, a "bottom-up" installation process, and are secured with a zipper or VELCRO® brand hook and loop fasteners along a seam at the back or side of the foot and ankle. These covers are made by the attachment of multiple precut fabric pieces, which creates multiples seams, allowing water to egress through the seams.

The third and most important weakness of the bottom-up design is that the seal around the ankle cannot be made sufficiently snug to prevent substantial water egress from above. The fourth weakness is that the bottom-up design is costly to produce, because of the materials, the attachment of multiple precut pieces of these materials to each other, and the formation of these seams and, as well as the attachment of stays or fasteners.

Accordingly, it is an object of the invention to provide a new and improved cycling shoe cover that overcomes the above deficiencies of the prior art.

It is a further object to provide such a shoe cover that can be made at significantly reduced costs.

The above and other objects, effects, features, and advantages of the present invention will become more apparent from the following description of the embodiments thereof taken in conjunction with the accompanying drawings.

SUMMARY OF INVENTION

In the present invention, the first object is achieved by providing a tubular member formed of an elastic waterproof material, the tubular member comprising: a first tubular portion having an upper opening at the proximal end disposed orthogonal to a primary axis thereof, and a distal end opposite the proximal end, and a second tubular portion closed at the distal end and connected in sealed unitary engagement at the proximal end in an orthogonal orientation to the distal end of the first tubular portion, and having a first generally elliptical opening on a lower portion thereof that is opposite the opening in the first tubular member.

A second aspect of the invention is characterized by a die for forming a sock like protective cover, the die comprising a first generally planar portion having a foot like shape with rounded edges and a second portion extending downward from the rounded edge of the sole portion of the first generally planar portion.

Another aspect of the invention is characterized by a method of forming a unitary elastic waterproof sock like protective cover, the method comprising the steps of providing the above die, coating the die with an elastomer forming liquid, solidifying the elastomer forming liquid on the die to replicate the shape of the die, removing the solidified form from the die, slitting the solidified form at an intermediate position on the second downward extending portion to leave a residual sleeve below a sole shaped lower portion of the sock like protective cover, rolling the residual sleeve upward on itself to form a thick continuous annular bead about the perimeter of the opening in the sole shaped lower portion of the sock like protective cover, wherein the rolled bead adheres to itself.

Another aspect of the invention is achieved by providing a unitary sock like tubular waterproof elastic member comprising an upper foot receiving portion on an upper surface thereof having a shape adopted to receive an ankle and heel of a person, and a lower sole portion at the bottom of the upper foot receiving portion having at least one generally elliptical hole formed therein.

Another aspect of the invention is characterized by providing a second generally elliptical opening on the lower sole portion or second tubular portion thereof.

Another aspect of the invention is characterized by the elastic waterproof material that forms the tubular member material has a greater thickness along the perimeter of the first and/or second generally elliptical opening than on the portions distal therefrom.

Another aspect of the invention is characterized by the perimeter of the first and/or second generally elliptical opening that include an annular bead with a circular cross-section having a thickness of about 2-4 mm.

Another aspect of the invention is characterized by the elastic waterproof material being capable of stretching at least about 25%.

The above and other objects, effects, features, and advantages of the present invention will become more apparent from the following description of the embodiments thereof taken in conjunction with the accompanying drawings.

BRIEF DESCRIPTION OF DRAWINGS

FIG. 1A is a top plan view of a first embodiment of the inventive shoe cover disposed in a relaxed configuration on a flat surface, whereas FIG. 1B is a cross-sectional elevation of the portion indicated by section line B-B in FIG. 1A.

FIG. 3A is a side elevation view of a mold used to form the shoe cover of FIGS. 1 and 2, whereas FIG. 3B is a front elevation view thereof and FIG. 3C is a cross-sectional elevation at section line C-C in FIG. 3A.

FIG. 6A is a side elevation view of a mold used to form the shoe cover of FIGS. 4 and 5, whereas FIG. 6B is a front elevation view thereof and FIG. 6C is a cross-sectional elevation at section line C-C in FIG. 6A.

FIG. 9A is a top plan view of another embodiment of the inventive shoe cover disposed in a relaxed configuration on a flat surface, whereas FIG. 9B is an enlarged cross-sectional elevation of the highlighted region in FIG. 9A.

FIG. 10A is a side elevation view of a mold used to form the shoe cover of FIGS. 8 and 9, whereas FIG. 10B is a front elevation view thereof and FIG. 10C is a cross-sectional elevation at section line C-C in FIG. 10A.

FIG. 11A is a side elevation view of a mold used to form the shoe cover of FIGS. 12-17, whereas FIG. 11B is a front elevation view thereof and FIG. 11C is a cross-sectional elevation at section line C-C in FIG. 11A.

DETAILED DESCRIPTION

Figures 1A, 1B:
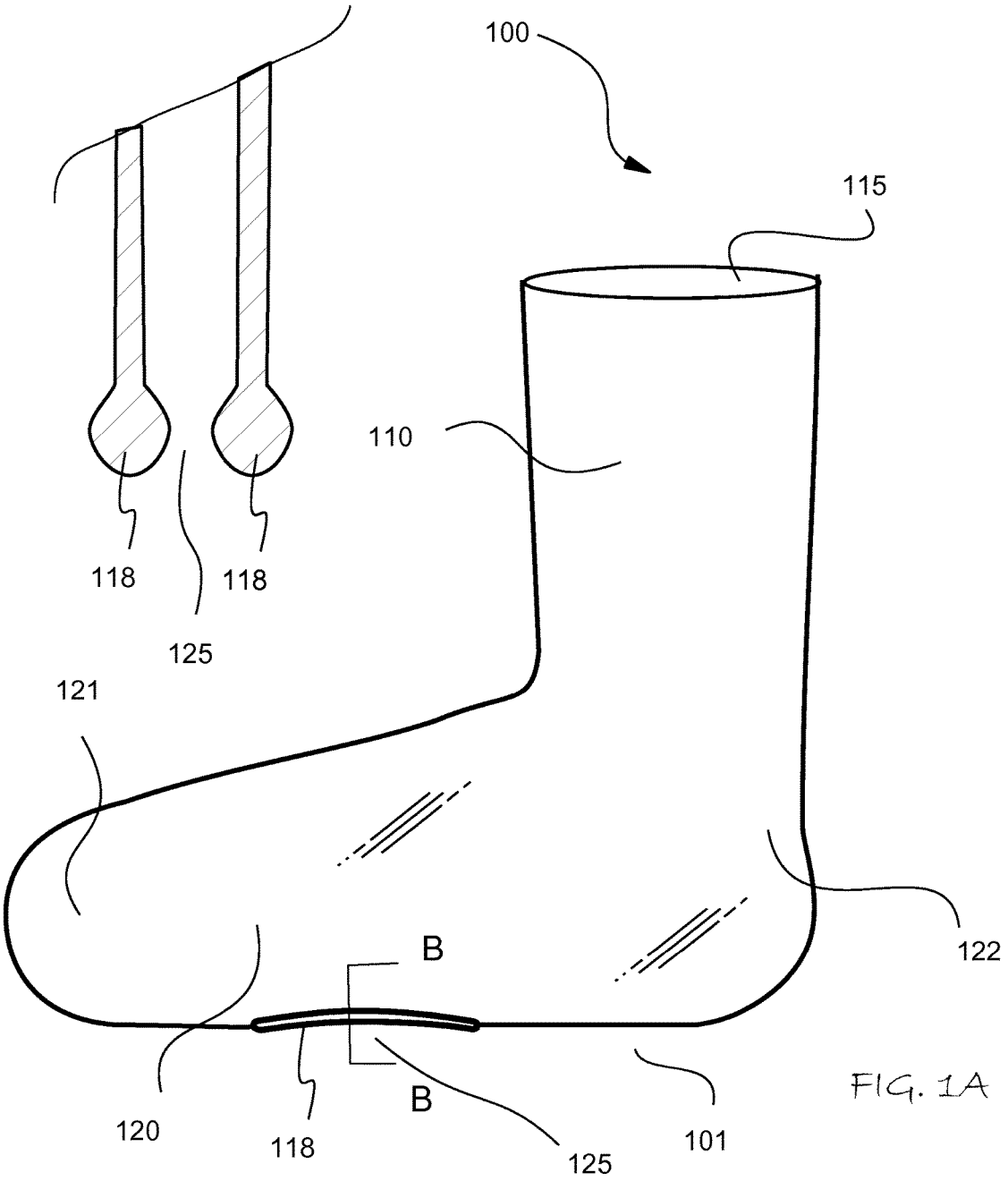

Referring to FIGS. 1 through 17, wherein like reference numerals refer to like components in the various views, there is illustrated therein a new and improved All Weather Cycling Shoe Cover, generally denominated 100 herein.

In accordance with the present invention, the All Weather Cycling Shoe Cover is a generally sock shaped elastic member 100 for protecting the shoe and foot of a cyclist from exposure to cold temperature, water, snow, mud and road debris. It is formed as a unitary thin elastic member from a waterproof material, such as natural rubber, natural rubber blends, latex rubber, synthetic rubber, polyisoprene, polychloroprene rubber (NEOPRENE®), nitrile rubber, butyl rubber, silicone rubber, polyvinyl chloride, polyurethane, and the like.

Figure 2:
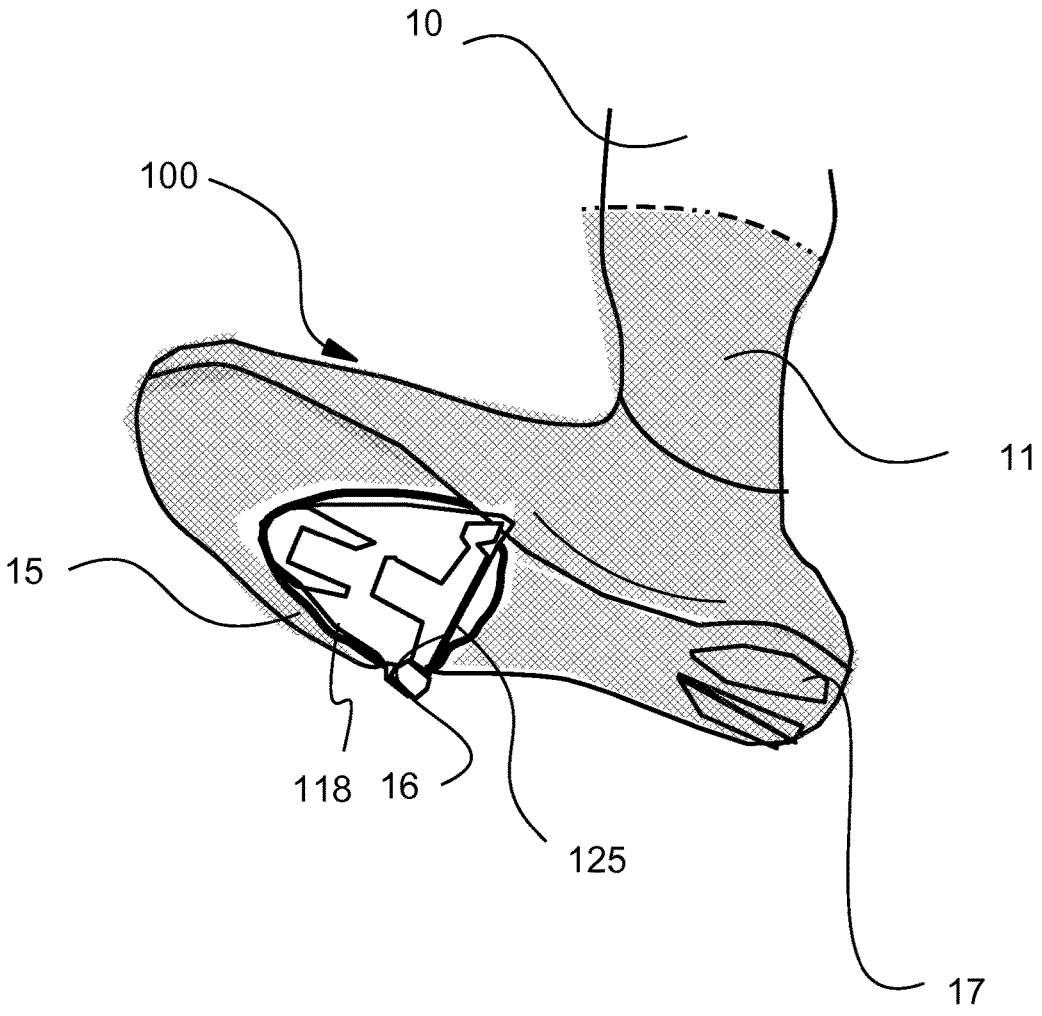
FIG. 2 is a perspective view showing the shoe cover of FIG. 1 installed over a cycling shoe, with the extent of the shoe cover illustrated by a mesh pattern.
Figure 5:
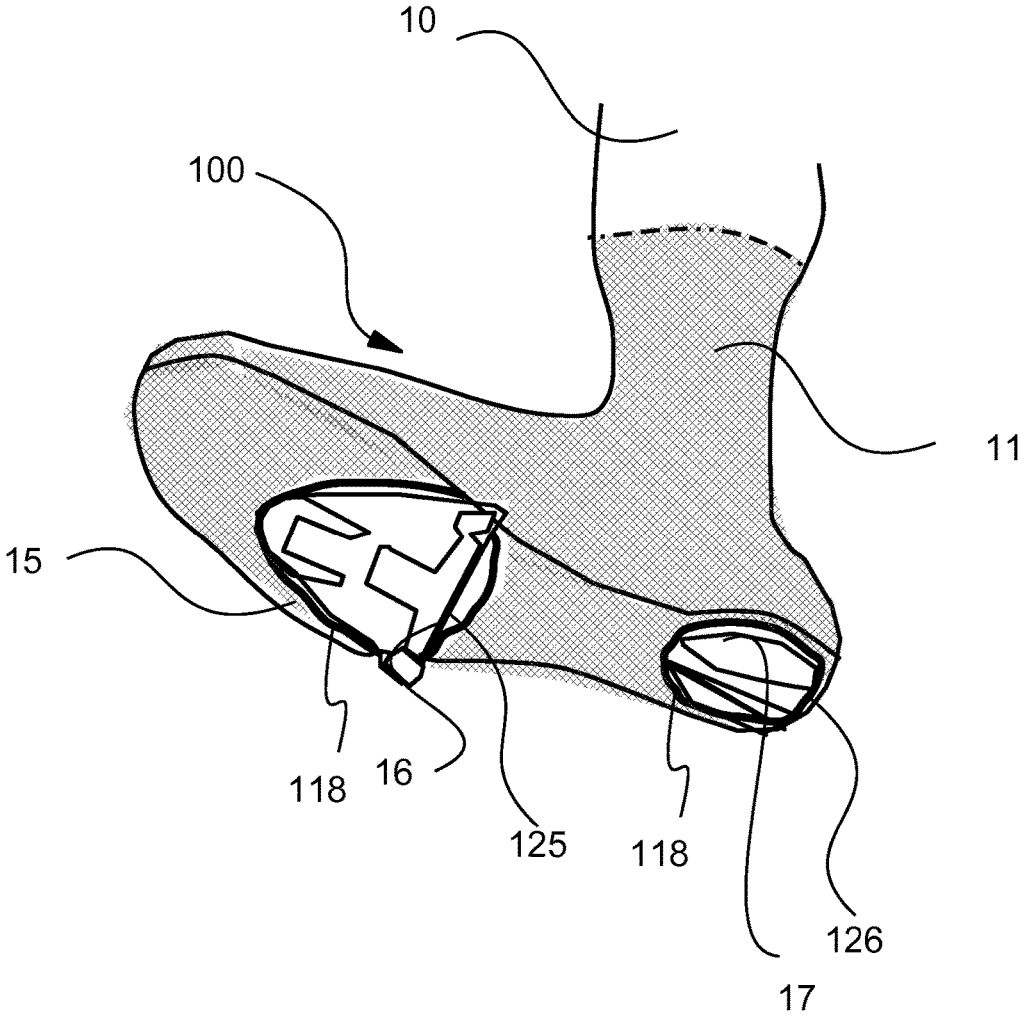
FIG. 5 is a perspective view showing the shoe cover of FIG. 4 installed over a cycling shoe, with the extent of the shoe cover illustrated by a mesh pattern.

In one embodiment of the invention, the sock like member 100 has a generally tubular shape when opened and elastically expanded by a shoe or foot and ankle that are wider than the sock like member 100. The sock like shape of shoe cover 100 is generally formed by a first generally cylindrically shaped tube member 110 having an opening 115 at the proximal end that is disposed orthogonal to a primary axis of the first generally cylindrically shaped tube member 110, and a second tubular member 120 is closed at a distal end 121 (for receiving the toe end of a shoe) connected in sealed engagement at the proximal end to the distal end of the first generally cylindrically shaped tube member 110. First generally cylindrically shaped tube member 110 is designed to snugly fit around the cyclist's upper ankle. The second tubular member is sloped downward from the intersection with the first generally cylindrically shaped tube member to snugly accommodate a shoe. The second tubular member 120 has at least one generally elliptical opening 125 around a lower or outer side portion thereof, which is on the opposing side of the shoe cover 100 from the first opening 115. The generally elliptical opening 125 is disposed on an outer side 101 of the second tubular member closer to the closed distal end 121 than the end connected to first generally cylindrically shaped tube member 110. When a first embodiment of the shoe cover 100 is installed as shown in FIGS. 2 and 5, the aperture or generally elliptical opening 125 accommodates a cleat 16 that extends downward from near the toe of shoe, while a heel piece 17 is optionally covered by the lower surface of shoe cover 100.

As the shoe cover 100 is intended to stretch over a user's 10 shoe 15 to provide a tight seal, the sock like member 100 need not have a full 3-dimensional pseudo or anatomical foot or shoe shape. Hence, the reference to the parts of the cover having a generally cylindrical or tubular shape should not be considered limiting, but merely exemplary, as alternative shapes in the general form of a foot, but smaller than the intended user's foot and shoe dimensions, will provide similar benefits.

Figure 4:
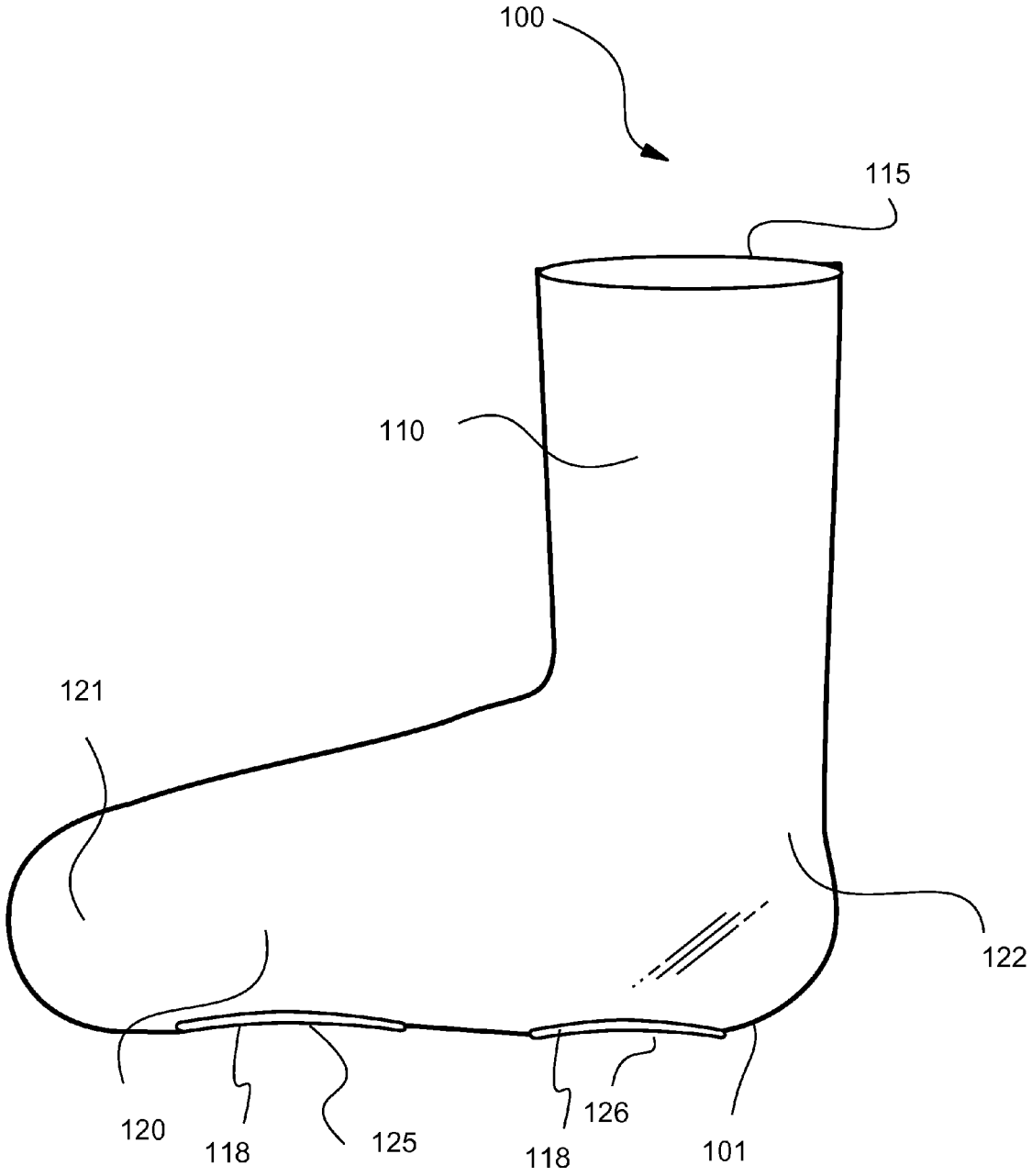
FIG. 4 is a top plan view of another embodiment of the inventive shoe cover disposed in a relaxed configuration on a flat surface.

In a second embodiment of the invention shown in FIG. 4, the sock like member 100 includes a second generally elliptical opening 126 disposed on the bottom between a proximal end 122 of the second tubular member 120 and first generally elliptical opening 125. The aperture or first generally elliptical opening 125 in FIG. 5 accommodates the cleat 16 that extends downward from the toe of the shoe, while the heel piece 17 extends through the second generally elliptical opening 126, shown in FIG. 5.

FIG. 3A-3B illustrates the process of forming the shoe cover sock like member 100 using a generally planar sock shaped die 300. The dimensions shown in FIG. 3A are in mm and are intended to be merely exemplary, and non-limiting. A face 310 of the die 300 is preferably flat, with all edges 311 rounded, preferably at a radius that is half the thickness of the die forming plate, which is preferably about ¼ inch (about 6-7 mm). The bottom of the die 300 that would correspond to the placement of the first generally elliptical opening 125 has a protuberance or extension 330 along an axis that is parallel to the cylindrical axis of what will become the first generally cylindrically shaped tube member 110, but extending in the opposite direction. The die 300 is held by this protuberance 330, as for example via the holes shown therein when dipped in an elastomer forming liquid, such as for example a concentrated solution of either latex or other elastic polymers, or a monomer, pre-polymer or other oligomeric liquid or mixture. A thin liquid coating will remain on die 300 upon removal and draining of excess liquid. Then, upon solidification of this liquid coating, such as upon drying to remove solvent, or alternatively the curing and cross-linking of the monomer, pre-polymer or other oligomer in the elastomer forming liquid, a thin elastic coating is formed on the die 300 having the general shape of a sock 100. It should be appreciated that the same die shape can be deployed when the liquid elastomer forming liquid is applied to the surface thereof by spray coating, curtain coating and the like.

After application and curing or otherwise sufficient solidification of the liquid elastomer forming compound on the outer surface of the die 300, the sock 100 is slit at positions 340 and optionally 350 to create a thicker perimeter around the generally elliptical openings 125 and 126. The portion 355 between slit position 350 and the intended bottom of outer side 101 of the sock 100 is rolled over itself to form a thicker edge or band 118 at the perimeter of the first generally elliptical opening 125 defined by protuberance 330. Slitting can occur after removal from die 300. However, in a more preferred embodiment of the invention, the perimeter of each generally elliptical opening 125 and 126 is considerably thicker than the elastic material that forms the body of the sock like member 100. When the sock like shoe cover 100 is formed of latex rubber, the thickness over the surface thereof distal from the first generally elliptical opening 125 is preferably about 0.2 mm to about 0.4 mm, with the thicker edge or band 118 at the first generally elliptical opening and/or second generally elliptical opening 126 preferably having a circular cross-section with a diameter of about 3 mm to about 5 mm, and more preferably about 4 mm. Preferably, heat is used to further cure the latex, and the slitting is carried out while the latex is hot to enable self adhesion and/or residual curing to complete the reactions necessary to form a strong and coherent thicker edge or band 118 upon rolling the portion between slit position 355 and the bottom of outer side 101.

In the embodiment shown in FIGS. 6A-C, the die 300 has a first and second protuberance 330 and 332 to form the generally elliptical hole or slit 125 and 126 respectively of the shoe cover shown in FIGS. 4 and 5. Edge 118 of generally elliptical opening 126 is similarly formed by rolling a portion 365 formed on the second die protuberance 332. It should be understood that either or both of holes 125 and 126 can optionally be circular and need not have a perfect elliptical shape, as the term elliptical is used to generally embrace rectangular holes with rounded comers or a slit with rounded sides. However, to the extent that the intended hole or slit 126 is not intended to stretch significantly on opening, the opening 126 may be formed without the use of protuberance 332, deploying for example die 300 of FIG. 3, and slitting the lower bottom surface of outer side 101 after molding.

Figure 7:
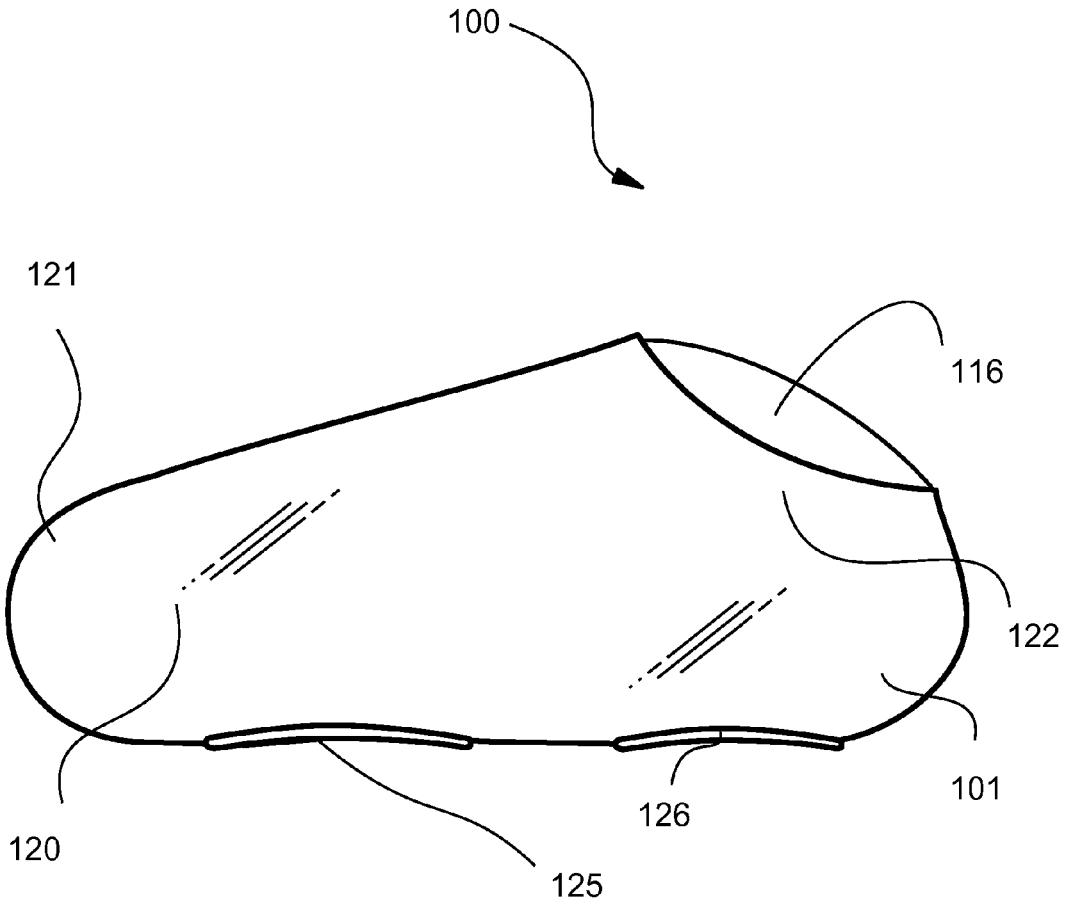
FIG. 7 is a top plan view of another embodiment of the inventive shoe cover disposed in a relaxed configuration on a flat surface.
Figure 8:
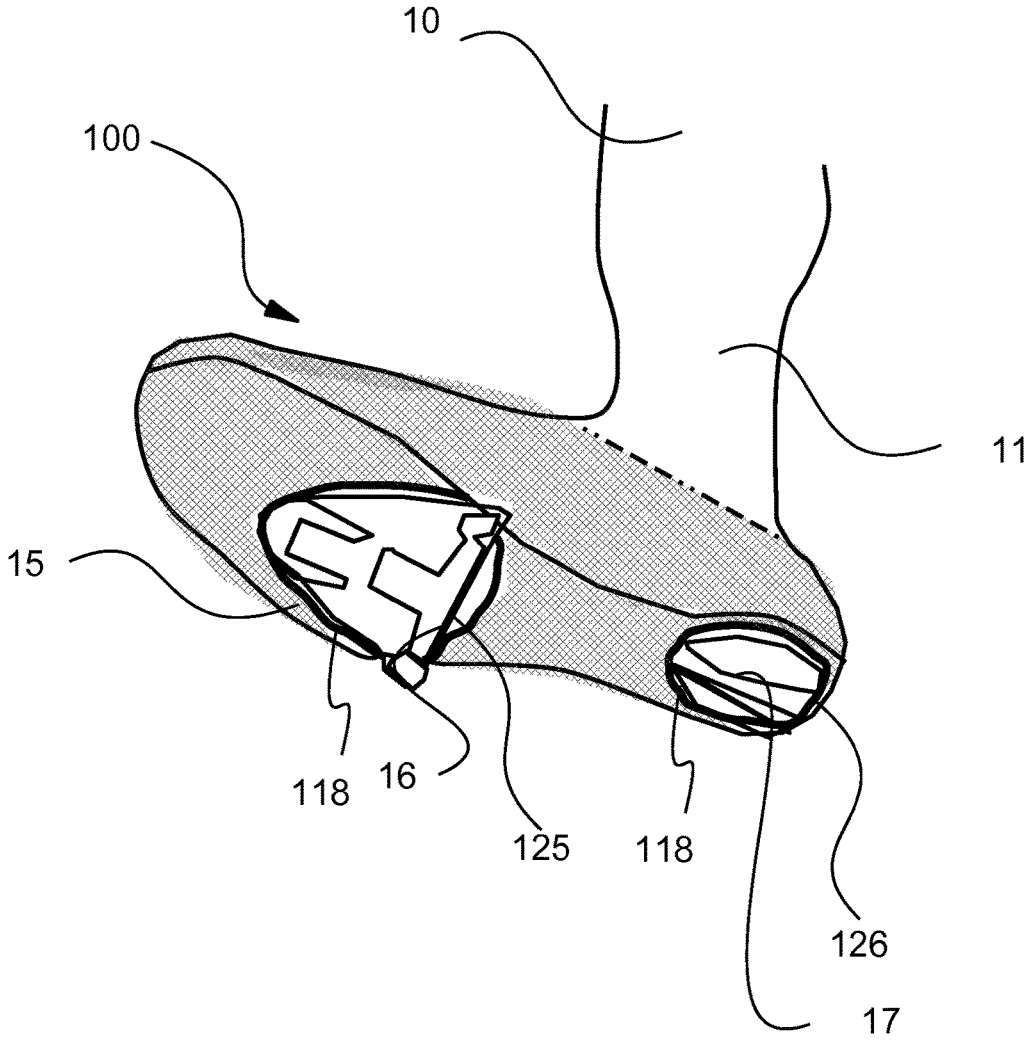
FIG. 8 is a perspective view showing the shoe cover of FIG. 7 installed over a cycling shoe, with the extent of the shoe cover illustrated by a mesh pattern.

In FIG. 7, the shoe cover 100 is formed by slitting the freshly cast preform after removal from the die 300 at reference line 340' (FIG. 6A), generally removing a significant portion of the first generally cylindrically shaped tube member 110 and placing an upper opening 116 at an acute angle across the primary axis of the second tubular member 120. FIG. 8 illustrates the expanded cover 100 of FIG. 7 installed to cover the shoe 15 of the user 10, in which a sock 13 is now exposed both above the shoe 15 and the shoe cover 100. The embodiment of FIG. 7 can be installed over the shoe after the user is wearing the shoe.

Figures 9A, 9B:
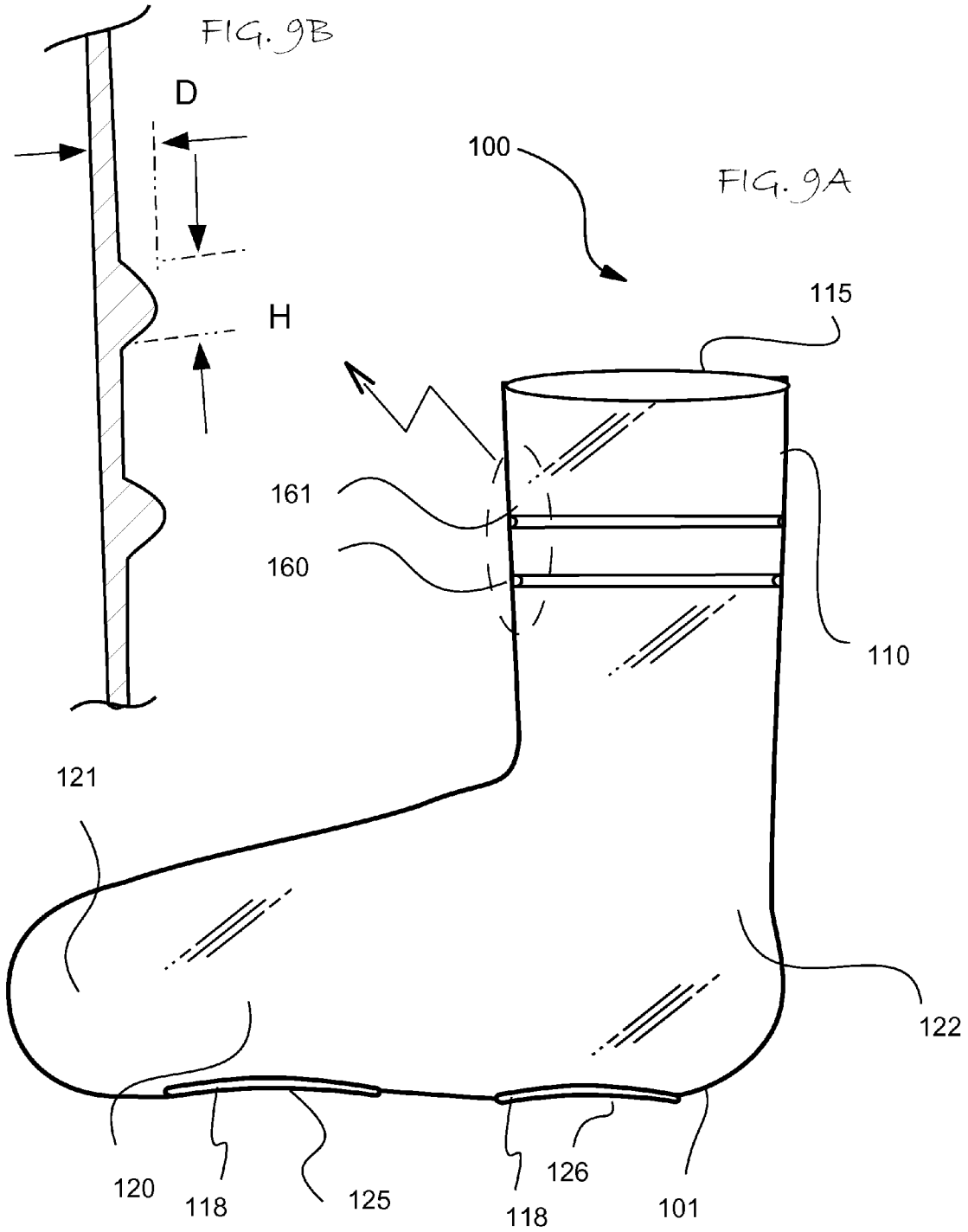
Figures 10A, 10B, 10C:
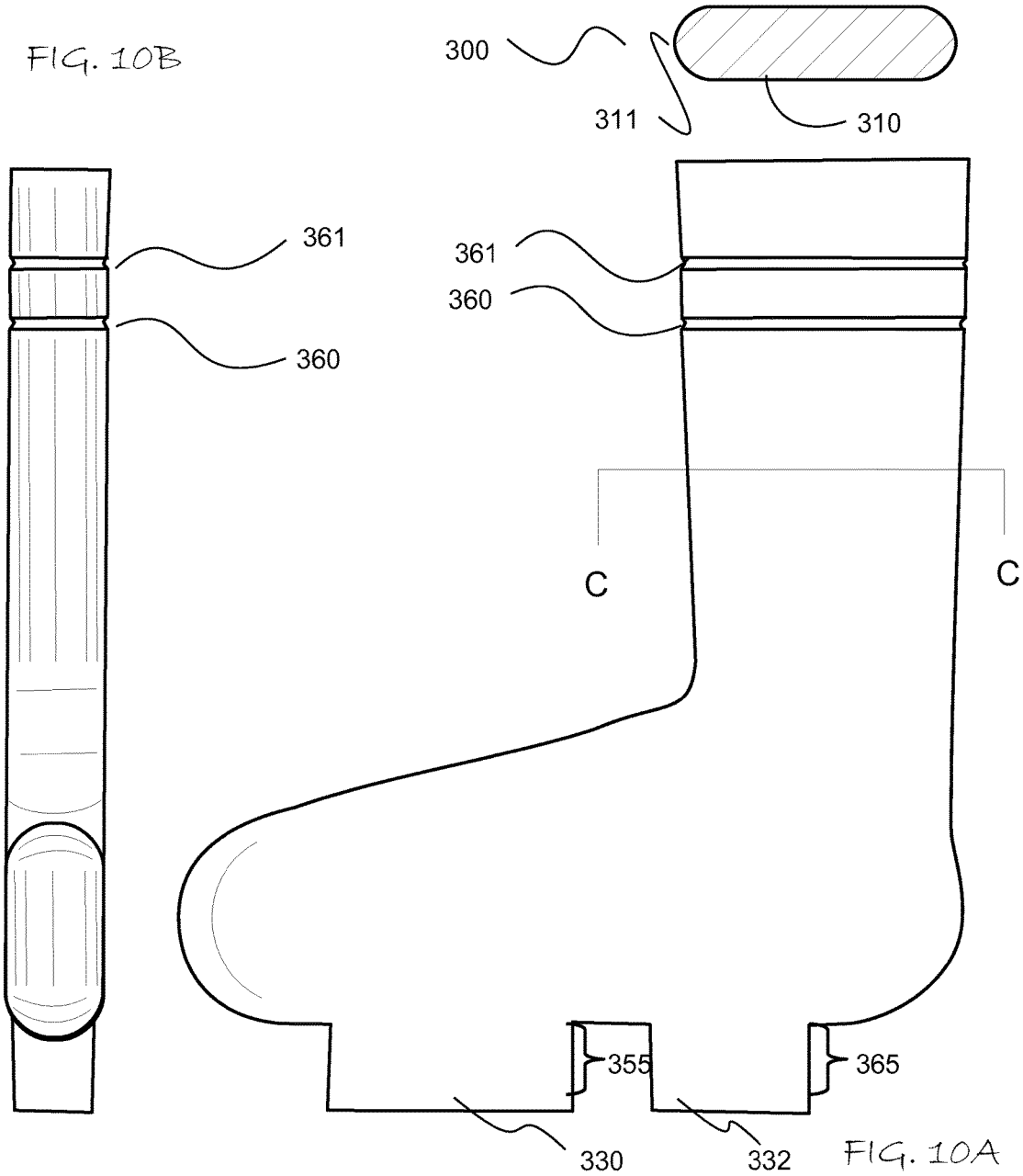

In a more preferred embodiment of the invention, illustrated with the aid of FIGS. 9A, 9B and FIG. 10, the die 300 in FIG. 10 has a series of two or more spaced apart and indented annular channels 360 and 361 around what will become the first generally cylindrically shaped tube member 110 of the sock 100. As the channels 360 and 361 will tend to retain more elastomer forming liquid compound on coating the die 300, due to surface tension, upon extraction from die 300 filled annular channels will replicate into a pair of spaced apart annular bands or flange 160 and 161 on the corresponding portion of the sock like shoe cover member 100 as shown in the embodiment in FIGS. 9A and 9B. Then, upon installation on an ankle 11 of the user 10, these bands 160 and 161, will form a tighter sealing surface by concentrating a compressive stress in a narrow region on the user's leg/ankle 11 or sock 13 to further preclude water egress in harsher conditions. As shown in FIGS. 9A and 9B, these bands 160 and 161 preferably have a height (H) of about 2-4 mm and a depth (D) of about 1.0 to about 1.5 mm. They are also preferably separated from each other by about 5 to 20 mm, and more preferably by about 10 mm, and are also preferably disposed about 5 to 20 mm, but more preferably about 10 mm, from the top of the sock like shoe cover 100.

In FIGS. 11A-C, the die 300 has a single large protuberance 330 that is intended to form a lower generally elliptical opening 125 in the bottom of the sock like shoe cover 100 shown in FIGS. 12-17.

Figure 12:
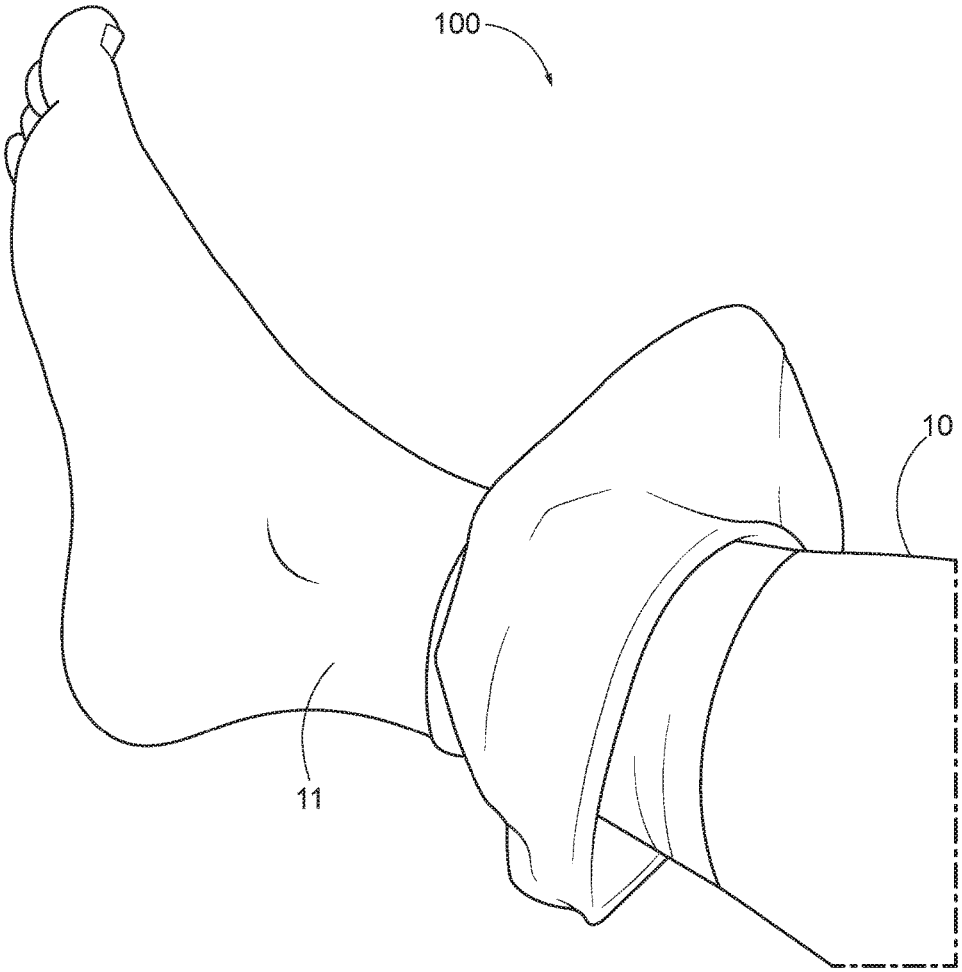
FIGS. 12, 13, 14 and 15 illustrate consecutive steps of a user installing the shoe cover constructed using the mold illustrated in FIGS. 11A-C, with the extent of the shoe cover illustrated by a mesh pattern.
Figure 13:
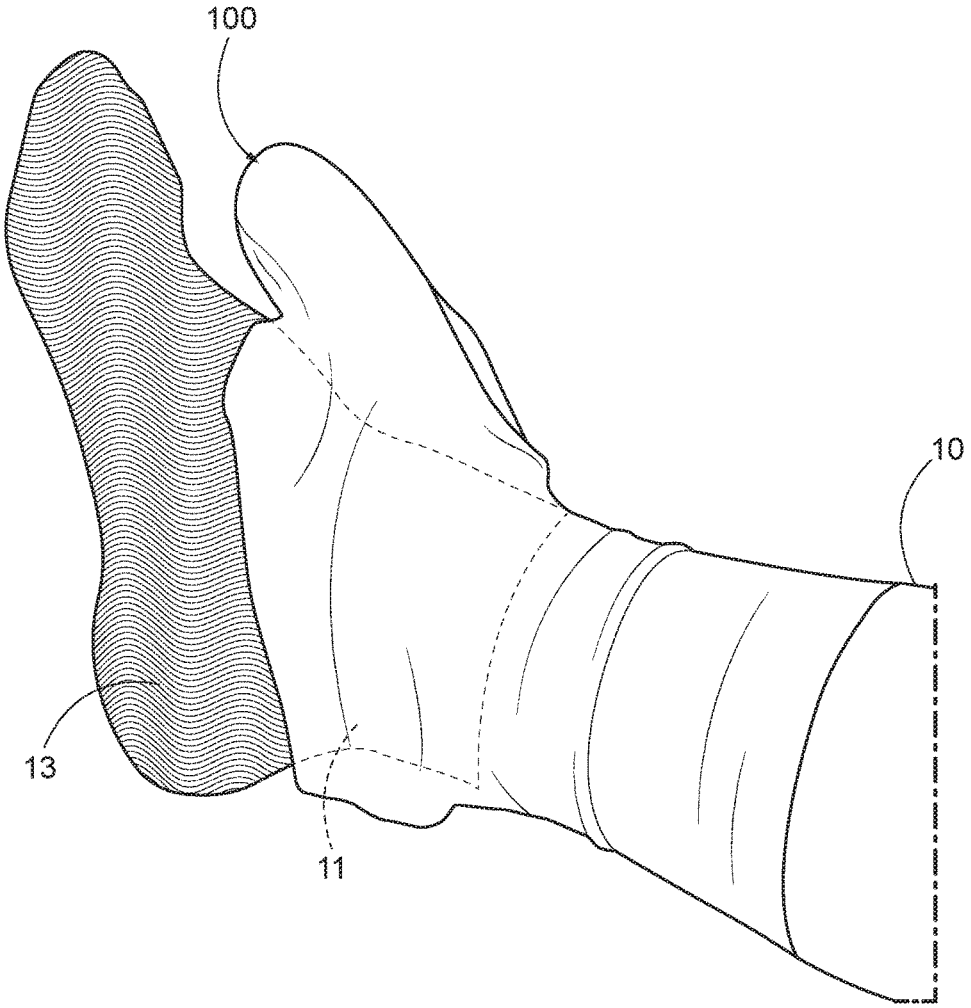
Figure 14:
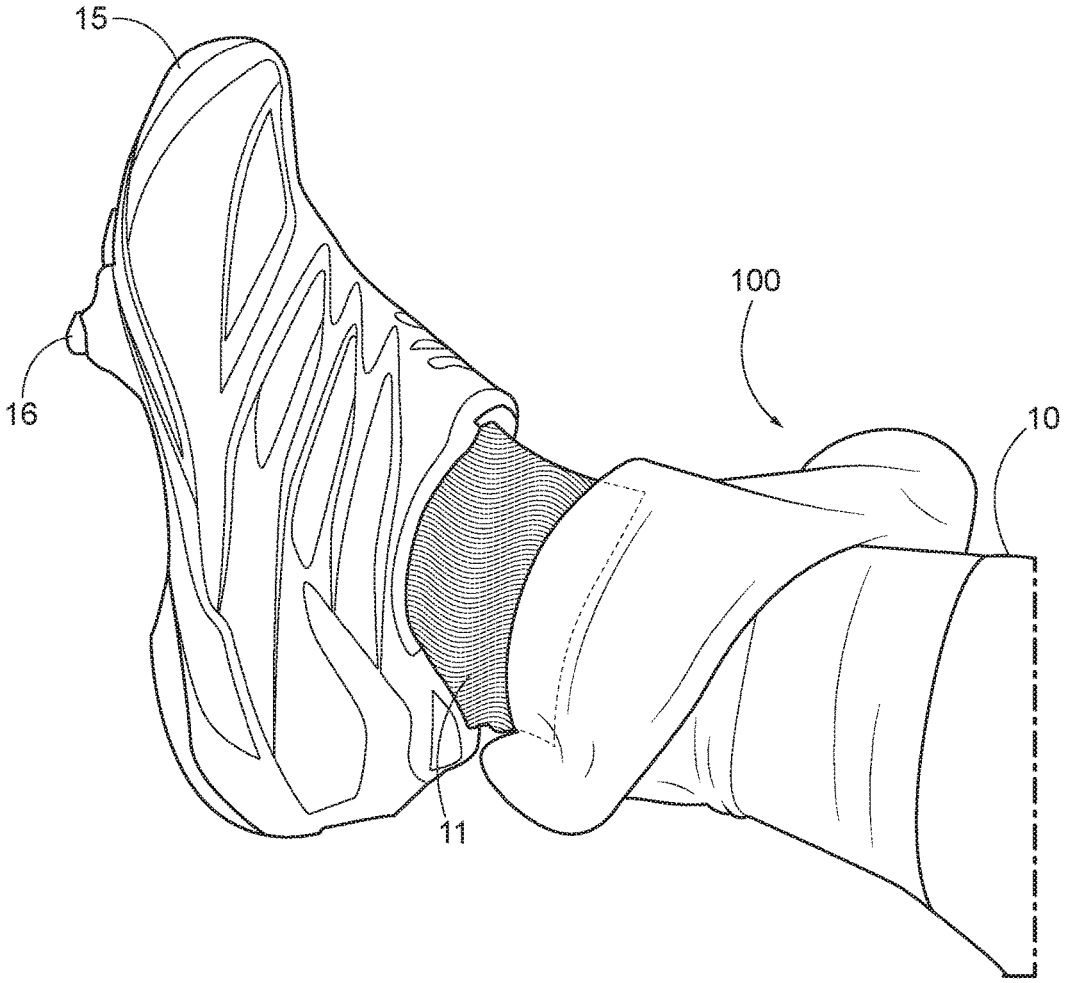
Figure 15:
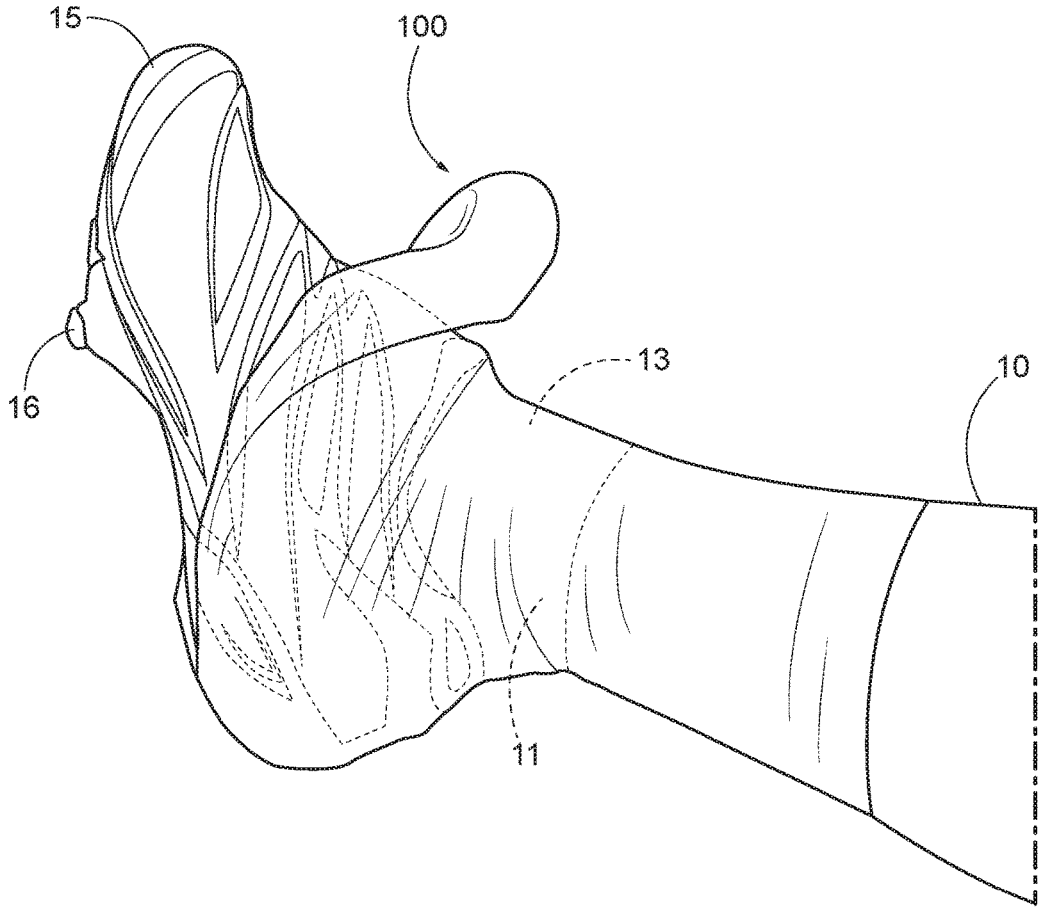
Figure 16:
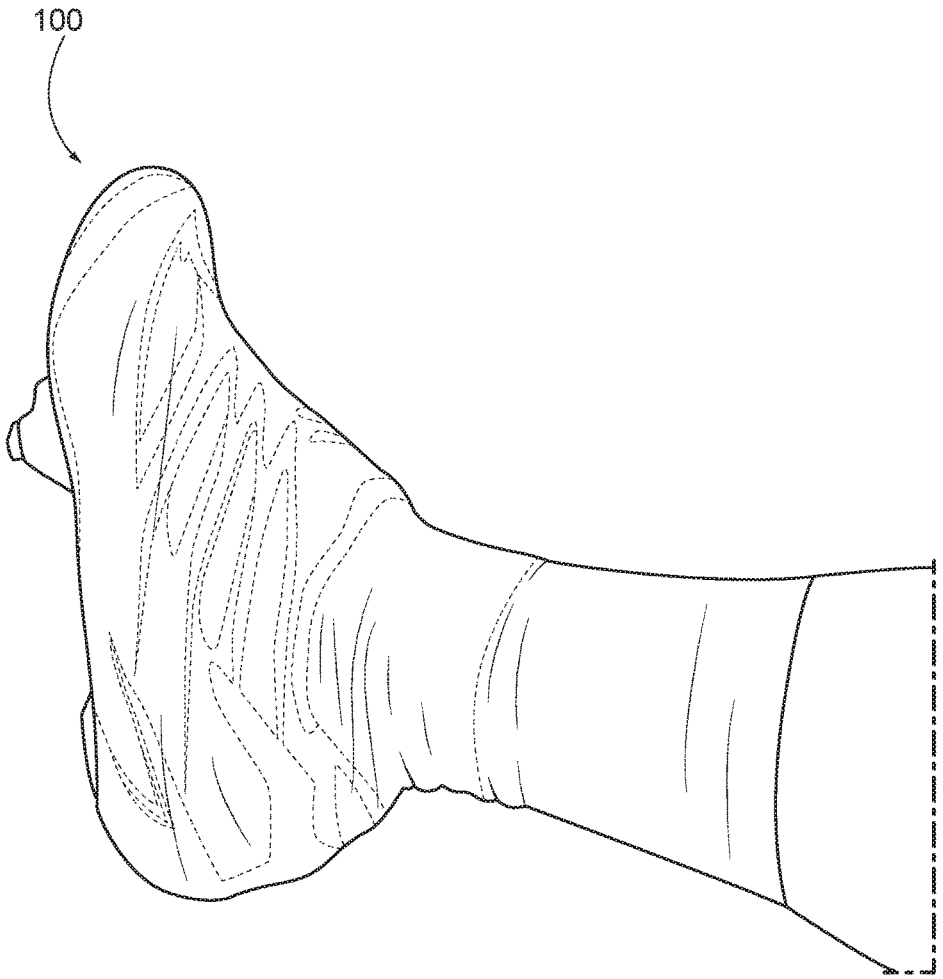
FIG. 16 is a first perspective view of the installed shoe cover constructed using the mold illustrated in FIGS. 11A-C, with the extent of the shoe cover illustrated by a mesh pattern.
Figure 17:
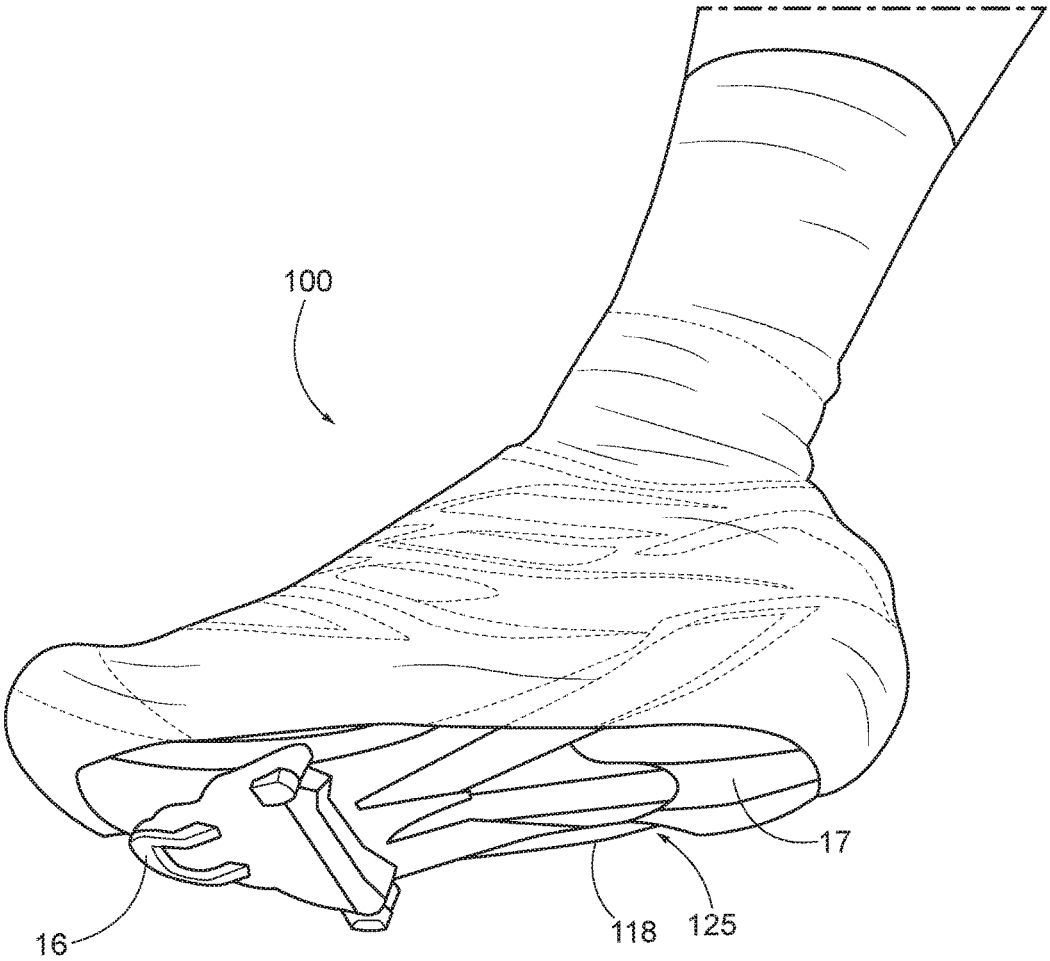
FIG. 17 is a first perspective view of the installed shoe cover constructed using the mold illustrated in FIGS. 11A-C, with the extent of the shoe cover illustrated by a mesh pattern.

It should now be appreciated that the sock like shoe cover of the various embodiments, is preferably placed on the ankle to form a water tight seal before or after socks are worn. Thus, as shown in FIG. 12, the user 10 first places the shoe cover 100 over the ankle 11, then puts on the sock 13, as shown in FIG. 13, and cycling shoe 15 in FIG. 14, and finally in FIG. 15 pulls the shoe cover 100 over the shoe 15 from above. The shoe cover 100 is flipped over the shoe and cradles the edge of the sole by about 1 cm all around to provide a secure fit. Because the shoe cover 100 will not be in contact with the cleat 16, it will not interfere with the engagement of the cleat 16 and a pedal of a bicycle. The aperture or opening 125 in FIG. 17 accommodates both the cleat 16, and the heel piece 17.

It should now be appreciated that the inventive shoe cover 100 uniquely and inventively departs from prior art design by enabling a "top-down" installation, which covers the entire shoe from above with a single piece of material. This ensures a tight seal around the ankle and the entire upper surface of the shoe, providing maximum water, snow, and wind resistance.

It should be understood that the shoe cover 100 is intended to stretch at least about 20 to 30% of the original length to form a snug fit at the user's 10 ankle or calf 11. However, the elastomer forming the shoe cover 100 should also be able to stretch without tearing, undergoing permanent deformation or strain hardening when stretched by at least about 40% to about 80%, and preferably at least 60% to fit over the shoe and retain a tight seal at the ankle 11 by remaining stretched to about 15 to 30%, and more preferably at least about 20%, on the user's calf and ankle above the shoe 15. However, the shoe cover 100 is also preferably sized so that once installed on the shoe it has preferably stretched at least about 20 to 30% at each hole or aperture in the sole portion and to both reduce water egress into the shoe from above and slippage of the cover during cycling.

For example, a well fitted shoe cover 100 will stretch about 60% at the portion that extends over the toe, and 80% to extend over the heel. Then upon fitting over the shoe 15, the elastic material while relaxing is still stretched preferably about 20 to 30% at the apertures 125 or 126 on the bottom or sole portion of the outer side 101.

If the shoe cover 100 needs to be removed from the shoe while the cleat is engaged with the pedal, the cyclist can simply tear the cover off and discard it. Whereas discarding a "bottom-up" shoe cover would be prohibitively expensive, discarding the "top-down" shoe cover (the present invention) would be economically feasible because the cover is made of a single-mold piece of inexpensive elastomer, such as latex rubber. In contrast, with the "bottom-up" shoe cover, the cyclist has to disengage the pedal from the cleat in order to remove the cover, which can be dangerous.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

The invention claimed is:

1. A waterproof sock shaped unitary tubular member formed from an elastic waterproof material for covering footwear, said waterproof sock shaped unitary tubular member comprising:

a first waterproof tubular portion having an upper opening defined at a proximal end disposed orthogonal to a primary axis of said first waterproof tubular portion, and a distal end opposite said proximal end, said upper opening being configured to receive an ankle and heel of a person therethrough; and a second waterproof tubular portion closed at a second tubular portion distal end and connected in waterproof sealed unitary engagement at a second tubular portion proximal end in an orthogonal orientation to said distal end of said first waterproof tubular portion, said second waterproof tubular portion having a first opening defined in a lower sole portion of said second waterproof tubular portion, wherein said first opening is opposite said upper opening of said first waterproof tubular portion and is configured to receive therethrough a portion of the footwear; wherein the first opening is a first elliptical opening when the second waterproof tubular portion is in a relaxed configuration; wherein said elastic waterproof material has a portion of greater thickness along a perimeter of said first opening than on portions distal the first opening; wherein said portion of greater thickness along said perimeter of said first opening is a continuous bead with a circular cross-section; and further wherein the continuous bead comprises a rolled up portion of the elastic waterproof material, and wherein the rolled up portion of the elastic waterproof material forming the continuous bead is a rolled up self-adhered portion of the elastic waterproof material.

2. The waterproof sock shaped unitary tubular member according to claim 1, wherein said first opening is configured to receive therethrough a cleat of the footwear when said waterproof sock shaped unitary tubular member is donned on the footwear.

3. The waterproof sock shaped unitary tubular member according to claim 1, further comprising a second opening defined in said lower sole portion of said second waterproof tubular portion, wherein said second opening is configured to expose a portion of a heel of the footwear when said waterproof sock shaped unitary tubular member is donned on the footwear.

4. The waterproof sock shaped unitary tubular member according to claim 3, wherein when the second waterproof tubular portion is in the relaxed configuration, said second opening has an elliptical configuration and is smaller in size than said first opening.

5. The waterproof sock shaped unitary tubular member according to claim 3, wherein said elastic waterproof material has a portion of greater thickness along a perimeter of said second opening than on portions distal the second opening, wherein said portion of greater thickness along said perimeter of said second opening is a continuous bead with a circular cross-section, and further wherein the continuous bead comprises a rolled up portion of the elastic waterproof material.

6. The waterproof sock shaped unitary tubular member according to claim 5, wherein the rolled up portion of the elastic waterproof material forming the continuous bead along said perimeter of said second opening is a rolled up self-adhered portion of the elastic waterproof material.

7. The waterproof sock shaped unitary tubular member according to claim 1, wherein said elastic waterproof material is a latex containing rubber with a thickness of 0.2 mm to 0.4 mm, and said continuous bead along said perimeter of said first opening has a diameter of 3 mm to 5 mm.

8. The waterproof sock shaped unitary tubular member according to claim 1, wherein said first waterproof tubular portion has a pair of interior annular bands on an inner surface of said first waterproof tubular portion disposed below said upper opening at said proximal end of said first waterproof tubular portion that is disposed orthogonal to said primary axis of said first waterproof tubular portion.

9. The waterproof sock shaped unitary tubular member according to claim 8, wherein said pair of interior annular bands have a thickness of 1.0 mm to 1.5 mm, and have a height of 2 mm to 4 mm.

10. A method of donning the waterproof sock shaped unitary tubular member of claim 1 over footwear worn by a person, said method comprising the steps of:

a) inserting a foot and an ankle of the person through the upper opening defined in the first waterproof tubular portion of said waterproof sock shaped unitary tubular member;

b) further inserting the foot into the second waterproof tubular portion of said waterproof sock shaped unitary tubular member;

c) still further inserting the foot completely through the first opening defined in the lower sole portion of said second waterproof tubular portion;

d) after the still further inserting, donning the footwear on the foot while the foot is exterior of said first opening;

e) after the donning the footwear, pulling said second tubular portion proximal end over a heel of the footwear; and f) after the donning the footwear, pulling said second tubular portion distal end over a toe portion of the footwear and receiving a cleat of the footwear through said first opening.

11. The method according to claim 10 further comprising, after step f), positioning said first opening so that no part of the cleat of the footwear is covered by said lower sole portion.

12. The method according to claim 10, wherein the lower sole portion further comprises a second opening, and wherein after step e), the method further comprises positioning the second opening defined in said lower sole portion over the heel of the footwear.

13. The method according to claim 10 further comprising, after step f), positioning said proximal end of said first waterproof tubular portion above a proximal end of a separate sock worn by the person.

14. The waterproof sock shaped unitary tubular member according to claim 1, wherein the second waterproof tubular portion is sloped downward from the first waterproof tubular portion.

15. A method for forming the waterproof sock shaped unitary tubular member of claim 1, the method comprising:

a) creating a die with waterproof elastomer forming liquid; wherein the die includes a first planar portion having a foot-like shape with a sole portion having rounded edges, wherein the die further includes a second portion extending downward from the sole portion of the first planar portion; and wherein the first planar portion defines the shape of the first waterproof tubular portion and the second waterproof tubular portion of the waterproof sock shaped unitary tubular member;

b) solidifying the waterproof elastomer forming liquid on the die to form a solidified form that replicates the shape of the die;

c) slitting the solidified form at an intermediate position on the second portion to leave a residual sleeve below a sole shaped lower portion of the waterproof sock shaped unitary tubular member;

d) rolling the residual sleeve upward on itself to form the rolled up portion of the continuous bead; and e) adhering the rolled up portion to itself.

16. A waterproof sock shaped unitary tubular member formed from an elastic waterproof material for covering footwear, said waterproof sock shaped unitary tubular member comprising:

a first waterproof tubular portion having an upper opening defined at a proximal end disposed orthogonal to a primary axis of said first waterproof tubular portion, and a distal end opposite said proximal end, said upper opening being configured to receive an ankle and heel of a person therethrough; wherein said first waterproof tubular portion has a pair of interior annular bands on an inner surface of said first waterproof tubular portion disposed below said upper opening at said proximal end of said first waterproof tubular portion that is disposed orthogonal to said primary axis of said first waterproof tubular portion; and a second waterproof tubular portion closed at a second tubular portion distal end and connected in waterproof sealed unitary engagement at a second tubular portion proximal end in an orthogonal orientation to said distal end of said first waterproof tubular portion, said second waterproof tubular portion having a first opening defined in a lower sole portion of said second waterproof tubular portion, wherein said first opening is opposite said upper opening of said first waterproof tubular portion and is configured to receive therethrough a portion of the footwear, and wherein the first opening is a first elliptical opening when the second waterproof tubular portion is in a relaxed configuration.

17. The waterproof sock shaped unitary tubular member according to claim 16, wherein said pair of interior annular bands have a thickness of 1.0 mm to 1.5 mm, and have a height of 2 mm to 4 mm.

18. A method of donning the waterproof sock shaped unitary tubular member of claim 16 over footwear worn by a person, said method comprising the steps of:

a) inserting a foot and an ankle of the person through the upper opening defined in the first waterproof tubular portion of said waterproof sock shaped unitary tubular member:

b) further inserting the foot into the second waterproof tubular portion of said waterproof sock shaped unitary tubular member;

c) still further inserting the foot completely through the first opening defined in the lower sole portion of said second waterproof tubular portion;

d) after the still further inserting, donning the footwear on the foot while the foot is exterior of said first opening;

e) after the donning the footwear, pulling said second tubular portion proximal end over a heel of the footwear; and f) after the donning the footwear, pulling said second tubular portion distal end over a toe portion of the footwear and receiving a cleat of the footwear through said first opening.

19. The method according to claim 18 further comprising, after step f), positioning said first opening so that no part of the cleat of the footwear is covered by said lower sole portion.

20. The method according to claim 18, wherein the lower sole portion further comprises a second opening, and wherein after step e), the method further comprises positioning the second opening defined in said lower sole portion over the heel of the footwear.

21. The method according to claim 18 further comprising, after step f), positioning said proximal end of said first waterproof tubular portion above a proximal end of a sock worn by the person.

* * * * *